US008322719B1

(12) United States Patent
Roth

(10) Patent No.: US 8,322,719 B1
(45) Date of Patent: Dec. 4, 2012

(54) SYSTEM AND METHOD FOR VARYING A NIP POINT

(75) Inventor: Curtis A. Roth, Post Falls, ID (US)

(73) Assignee: J&L Group International, LLC, Keithsville, LA (US)

( * ) Notice: Subject to any disclaimer, the term of this patent is extended or adjusted under 35 U.S.C. 154(b) by 0 days.

(21) Appl. No.: 13/166,209

(22) Filed: Jun. 22, 2011

(51) Int. Cl.
*B65H 5/02* (2006.01)

(52) U.S. Cl. ..... 271/272; 271/69; 271/306; 271/198

(58) Field of Classification Search ..... 271/272, 271/69, 306, 198, 199; 198/626.3, 626.5, 198/626.4, 606; 83/155, 949
See application file for complete search history.

(56) References Cited

U.S. PATENT DOCUMENTS 2,467,423 A * 4/1949 Bruker ..... 271/69
4,189,965 A * 2/1980 Kollann ..... 83/155
4,385,537 A * 5/1983 Wolf ..... 83/100
7,052,009 B2 5/2006 Roth
2004/0245071 A1 12/2004 Giffin
2011/0285080 A1 11/2011 Gendreau et al.

* cited by examiner

*Primary Examiner* — David H Bollinger
(74) *Attorney, Agent, or Firm* — Dorsey & Whitney LLP; Kenneth E. Levitt, Esq.

(57) ABSTRACT

A system for conveying sheets of corrugated paperboard material or other materials. The system includes a processing module configured for transferring the material in a conveying direction, the processing module having a first nip point. A conveyor is positioned downstream of the processing module and also configured for transferring the material in the conveying direction. The conveyor includes a first support roller and second support roller having a first conveyor belt wound therearound, with the belt defining a deflector section extending from the first support roller to the second support roller. Similar to the processing module, the conveyor includes a second nip point. An adjustment drive can be operatively associated with either or both of the first and second support rollers and configured to adjust the position of the second nip point in or counter to the delivery direction.

19 Claims, 3 Drawing Sheets

SYSTEM AND METHOD FOR VARYING A NIP POINT

FIELD OF THE INVENTION

The present disclosure relates generally to an apparatus and method for processing and conveying sheets, and more specifically to an apparatus and method for conveying sheets from a nip point of a rotary die drum to a nip point of a conveyor.

BACKGROUND OF THE INVENTION

Various conveyance and processing devices are commonly used to transport and process blanks or stock material from a feed conveyor, through an assembly line or process. For example, in the production of packaging, webs of cardboard, paperboard, or corrugated material are moved through a rotary press or die drum to convert the web into individual blanks or sheets. In other instances, individual blanks or sheets move through various processing stations to have different functions performed on them, such as printing, cutting, etc. Individual sheets may be transferred from a die drum to a conveyor.

In traditional systems, to maintain control of the sheets during transfer from a die drum to a conveyor, the sheets are transferred from a nip point of the die drum to a nip point of the conveyor, e.g., a takeaway conveyor, and the distance between these nip points is static. However, it may be desirable to process sheets of varying length. Therefore, sheets that are longer than the distance between the nip point on the die drum and the nip point on the conveyor can be nipped by both the die drum and the conveyor at the same time. Such nipping of an individual sheet in two areas along its length simultaneously is undesirable. For example, if the speed of the die drum differs from that of the takeaway conveyor, portions of the sheets may be subjected to forces that result in damage to the sheets (e.g., skewing, marking, tearing). These forces, which may result in the slippage of a nip point over the material being transported and processed, can cause other damage as well, such as smearing of or damage to printing.

In one traditional system, the takeaway conveyor has been designed to include three support rollers at the end of the conveyor proximate the die drum. The conveyor belt is alternatingly wound around the three support rollers in a "S"-like manner. At least two of the support rollers are designed to be moveable such that the location of the nip point of the takeaway conveyor can be changed, and thus, the distance between the nip point on the die drum and the nip point on the conveyor can be changed. However, such configuration leaves at least one of the support rollers exposed outside the conveyor belt and accessible by incoming sheets. Accordingly, as a sheet approaches the front edge of the takeaway conveyor, it can be undesirably deflected toward and/or into the exposed roller, causing damage to the sheet and/or requiring stoppage of the conveyor for correction. In order to curb such undesirable deflection, this traditional system includes a relatively small deflector plate, typically comprised of metal, that extends across at least a portion of the area in which the exposed support roller is positioned. However, this deflector plate does not extend across very much of the front edge of the takeaway conveyor and thus does not entirely cover the area in which the exposed support roller is positioned. As such, there still exists the potential for undesirable deflection of the sheets toward and/or into the exposed roller, causing damage to the sheet and/or requiring stoppage of the conveyor for correction. Furthermore, having a deflector plate causes friction between the plate and the sheets, and can damage the sheets and any ink or markings on them. In a different device, a series of small rollers positioned on a shaft has been positioned on the intake end of a stacker, where the longitudinal position of the shaft can be adjusted. However, this configuration allows for minimal control over the sheets, and it is not able to deflect sheets under the rollers.

Accordingly, there is a need in the art for an apparatus and method that allows for adjustment of the distance between the nip points of adjacent processing apparatuses.

BRIEF SUMMARY OF THE INVENTION

In one embodiment, the present disclosure relates to a system for conveying material. The system includes a processing module configured for transferring the material in a conveying direction, the processing module having a first nip point. A conveyor is positioned downstream of the processing module and also configured for transferring the material in the conveying direction. The conveyor includes a first support roller and second support roller having a first conveyor belt wound therearound, with the belt defining a deflector section extending from the first support roller to the second support roller. Similar to the processing module, the conveyor includes a second nip point. An adjustment drive can be operatively associated with either or both of the first and second support rollers and configured to adjust the position of the second nip point in or counter to the delivery direction.

In another embodiment, the present disclosure relates to a method for conveying material. The method includes passing a first sheet of material having a first length through a processing module, the processing module comprising a first nip point. The first sheet is then transported in a conveying direction towards a conveyor positioned downstream of the processing module and also configured for transferring the material in the conveying direction. The conveyor includes a first support roller and second support roller having a first conveyor belt wound therearound, with the belt defining a deflector section extending from the first support roller to the second support roller. Similar to the processing module, the conveyor includes a second nip point. A gap distance is defined by the distance between the first nip point and the second nip point. Substantially during transport of the first sheet from the processing module to the conveyor, the gap distance is substantially equal to the first length. The method further includes passing a second sheet of material having a second length through the processing module, wherein the second length is different than the first length, and adjusting the gap distance such that it is substantially equal to the second length.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure relates generally to an apparatus and method for processing and conveying sheets, and more specifically to an apparatus and method for conveying sheets from a nip point of a rotary die drum to a nip point of a conveyor. The systems and methods disclosed herein may be used, for example, by manufacturers and processors of corrugated paper products to minimize damage to sheets of the products being transferred from a nip point of a first processing apparatus to a nip point of a second processing apparatus, while maintaining sufficient control of the sheet throughout the transfer.

Figure 1:
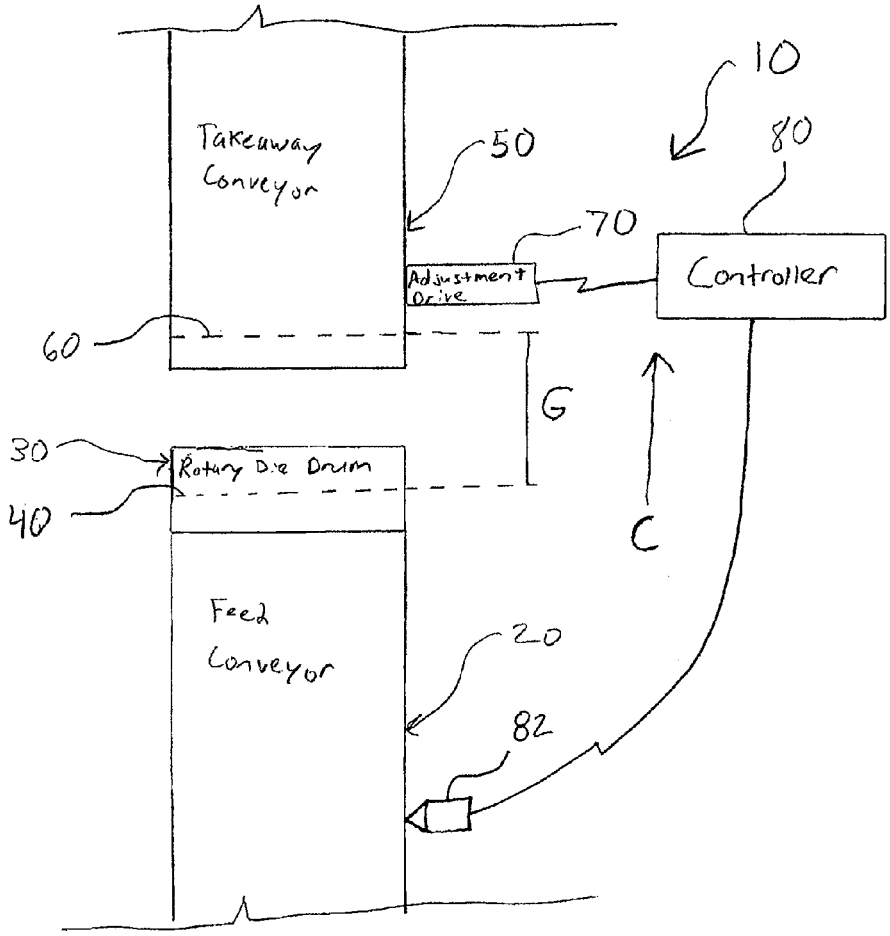
FIG. 1 illustrates an elevation top view of a schematic of an example system environment for carrying out the systems and methods of the present disclosure.

FIG. 1 illustrates a schematic diagram of an example system environment 10 for carrying out the systems and methods of the present disclosure. The system environment 10 may include a feed conveyor 20, a first processing module, which may be, but is not limited to, a rotary die drum 30, having a first nip point 40, a second processing module, which may be a takeaway conveyor 50, having a second nip point 60, the first and second nip points 40, 50 being separated in a conveying direction by a gap distance G, an adjustment drive 70 associated with the takeaway conveyor 50, and a control system 80, the control system 80 being in communication with the adjustment drive 70. Collectively, the feed conveyor 20, rotary die drum 30, and takeaway conveyor 50 may define a portion of a conveying path for transporting and processing material. While the present disclosure is described with respect to embodiments in which the first and second processing modules are a rotary die drum and a takeaway conveyor, respectively, it is to be appreciated that the systems and methods disclosed herein may be employed with any processing modules, which are configured to transfer material and include a nip point for capturing or grabbing the material during transfer.

For the purposes of the present disclosure, a leading edge of a sheet may refer to the front or leading edge of the sheet as it travels along the conveying path in the conveying direction C and a trailing edge of a sheet may refer to the back or trailing edge of the sheet as it travels along the conveying path in the conveying direction C. Also, for the purposes of the present disclosure, a sheet length may refer to a dimension of the sheet measured along the direction of travel.

In some embodiments, the feed conveyor 20 may be configured and operable for feeding a web and/or individual sheets of material in a conveying direction C to the rotary die drum 30. The feed conveyor 20 may be a belt conveyor, such as a belt conveyor that includes a single belt extending across the width of the apparatus, or a plurality of laterally spaced individual belt conveyors or belt conveyor sections. Alternatively, the feed conveyor 20 may be a roller conveyor or a ball belt conveyor. In further alternatives, the feed conveyor 20 may be any type of conveying mechanism suitable to convey the type of material being conveyed. In one implementation, the web and/or individual sheets may be formed of paper or corrugated material. Alternatively, the web and/or individual sheets may be formed of any material suitable for transfer along the feed conveyor 20 such as, for example, plastic or metal.

In various embodiments, the rotary die drum 30 may be configured to perform one or more processing operations on the material being conveyed. For example, in embodiments in which the rotary die drum is fed a web of material, the rotary die drum 30 may be configured to cut individual sheets of selected length and/or width from the web of material. Alternatively, or additionally, the rotary die drum 30 may be configured to score the material, thereby forming a series of fold lines about which the material is to be folded, according to the desired configuration of a container to be formed from the material.

Figure 2:
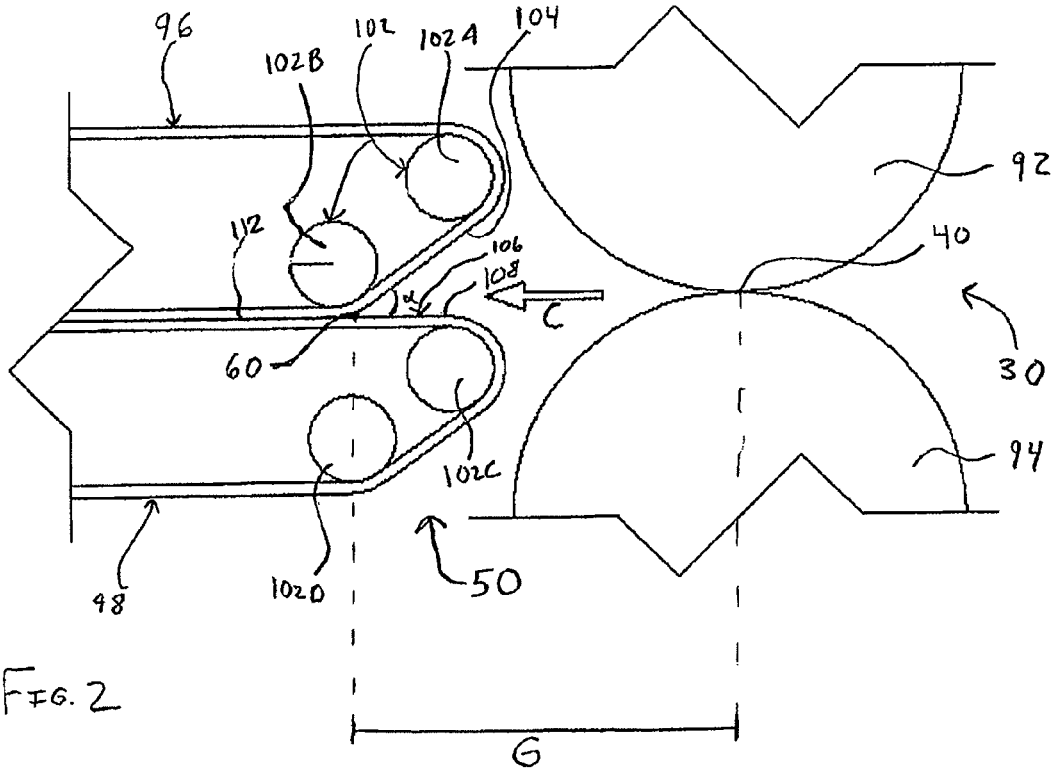
FIG. 2 illustrates an elevation side view of a schematic of a rotary die drum and a takeaway conveyor in accordance with one embodiment of the present disclosure.

As shown in FIG. 2, in some embodiments, the rotary die drum 30 may include a top drum 92 and a bottom drum 94 which cooperate to perform processing operations on the material being conveyed through the rotary die drum 30. A first nip point 40 may be defined as a point of convergence between the top and bottom drums 92, 94, which nips or grabs the leading edge of the material as it is fed through the rotary die drum 30 and directed toward the takeaway conveyor 50.

As will be appreciated by those skilled in the art, in the conveyance apparatuses discussed herein, conveyance speeds of up to about 1000 feet per minute may be achieved. At such elevated speeds, even slight misalignment or imperfections in the sheets (e.g., warps, bent flaps, etc.) transferred from the rotary die drum 30 to the takeaway conveyor 50 can cause the sheets to be deflected from the takeaway conveyor 50, thereby further damaging the sheets and/or causing line stoppages. Accordingly, to improve control of the sheets during transfer, and mitigate sheet deflection, as will be discussed in more detail below, a second nip point 60 may be formed by the takeaway conveyor 50, which captures the sheets as they are received from the rotary die drum 30. As discussed above, while the present disclosure is described with respect to embodiments in which sheet transfer is between a nip point of a rotary die drum and a nip point of a takeaway conveyor, it is to be appreciated that the systems and methods disclosed herein may be employed with any processing modules adjacent one another in a processing line, which are configured to transfer material and include a nip point for capturing or grabbing the material during transfer.

In illustrative embodiments, the takeaway conveyor 50 may be formed as a belt conveyor having a top belt 96 and a bottom belt 98. Either or both of the top and bottom belts 96, 98 may be single belts extending across the width of the apparatus, or alternatively, may be a plurality of laterally spaced individual belt conveyors or belt conveyor sections laterally spaced from one another. The top and bottom belts 96, 98 may move in unison to frictionally engage and convey sheets of material along the takeaway conveyor 50 and toward a further processing module in the direction indicated by the conveying direction C. The top and bottom belts 96, 98 may be conventional conveyor belts used in the corrugated, paperboard or other sheet conveyance industry. The top and bottom belts 96, 98 may be endless belts, or other means currently known in the art to transport or convey sheets.

In some embodiments, the top and bottom belts 96, 98 may be supported by a plurality of belt support rollers 102, at least one of which may be driven to provide the takeaway conveyor 50 with its belt or line speed. The top belt 96 may be supported by an upper or nose support roller 102A and a lower or nip support roller 102B, each positioned on an end of the takeaway conveyor 50 proximate the rotary die drum 30. As shown in FIG. 2, the nip support roller 102B may be positioned axially below the nose support roller 102A and at a position which is downstream of the nose support roller 102A such that a deflector belt section 104 may be defined therebetween. In some embodiments, the deflector belt section 104 may form an acute angle $\alpha$ with respect to an upper surface 106 of the bottom belt 98. In this manner, sheets transferred from the rotary die drum 30 to the takeaway conveyor 50, which due to for example, warping, skewing, deflecting, and the like, would be directed away from the upper surface 106, may be guided by the deflector belt section 104 to the upper surface 106 of the bottom belt for transfer by the takeaway conveyor 50. In addition, the deflector belt section 104 can extend the entire distance between the nose support roller 102A and nip support roller 102B, thereby creating a significant and relatively large deflector section which can properly guide the sheets desirably toward the nip point 60. Specifically, the deflector belt section 104 can generally extend the entire distance from and between the nose support roller 102A and nip support roller 102B, thereby designating the entire distance to proper deflection. Alternatively, the nip support roller 102B may be positioned at substantially the same position along the conveying path as the nose support roller 102A or at a position which is upstream of the nose support roller 102A. In further alternatives, one or more additional support rollers may be positioned between the nose support roller 102A and the nip support roller 102B.

As with the upper belt 96, the lower belt 98 may be supported by an upper support roller 102C and a lower roller 102D, which are positioned relative to one another substantially similarly to rollers 102A, 102B. In some embodiments, the nip support roller 102B may be positioned downstream of the upper support roller 102C such that a landing section 108 is defined by a portion of the upper surface of the that is upstream of the nip support roller 102B. The landing section 108 of the upper belt 96 may support the leading edges of the sheets as they are fed from the rotary die drum 30 and approach the second nip point 60. Alternatively, the nip support roller 102B may be positioned at substantially the same position along the conveying path as the upper support roller 102C or at a position which is upstream of the upper support roller 102C.

In various embodiments, the upper belt 96 and its support rollers 102 may be positioned relative to the lower belt 98 and its support rollers 102 such that a lower surface 112 of the upper belt 96 and the upper surface 106 of the lower belt 98 are proximate or substantially or nearly abutting. The second nip point 60 may be defined as the upstream-most point of convergence between the top and bottom belts 96, 98, which initially nips or grabs the leading edges of the sheets as they are fed in the conveying direction C from the rotary die drum 30. In this manner, control of the sheets may be maintained throughout the transfer between the rotary die drum 30 and the takeaway conveyor 50. As shown in FIG. 2, a gap distance G may be defined as the distance, in the conveying direction C, between the first nip point 40 and the second nip point 60. In one embodiment, the height of the first nip point 40 (i.e., the position of the nip point in a direction normal to the conveying direction) may be slightly greater than the height of the second nip point 60 to accommodate bending of the sheets due to the force of gravity. Alternatively, the first nip point 40 may be positioned at any desired height relative to the second nip point 60.

As will be appreciated by those skilled in the art, to maintain a desirable amount of control, or in some embodiments optimal control, of the sheets during transfer between the rotary die drum 30 and the takeaway conveyor 50, a trailing edge of the sheets may not be released from the first nip point 40 before the leading edge of the sheets is captured by the second nip point 60. However, as discussed above, simultaneous nipping of an individual sheet at two positions along its length can result in overconstraint of the sheet which, in turn, can result in damage to the sheet (e.g., skewing, marking, tearing). Therefore, in order to balance the need to maintain control of the sheets during transfer with the risk of damage to the sheets, in some embodiments, the system may be configured such that the gap distance G may be set at substantially the length of the sheet being transferred, or slightly greater or even slightly lesser than the length of the sheet being transferred. In this manner, the trailing edges of sheets transferred from the rotary die drum 30 to the takeaway conveyor 50 may be released from the first nip point 40 as, or just prior to, the leading edge is captured by the second nip point 60.

As will be appreciated by those skilled in the art, it is often desirable to process sheets of varying length on a given conveying/processing system. Therefore, in order to achieve a gap distance G that approximates the length of the sheet being transferred, in various embodiments, either or both of the rotary die drum 30 and the takeaway conveyor 50 may be provided with means for changing the gap distance G, such as an adjustment drive 70. For purposes of the present disclosure, an adjustment drive 70 may refer to any apparatus or device which may be operably coupled to the rotary die drum 30, the takeaway conveyor 50, or individual components thereof, which, through manual manipulation by operators and/or automatic manipulation via a control system, may be actuated to change the gap distance G.

Figure 3:
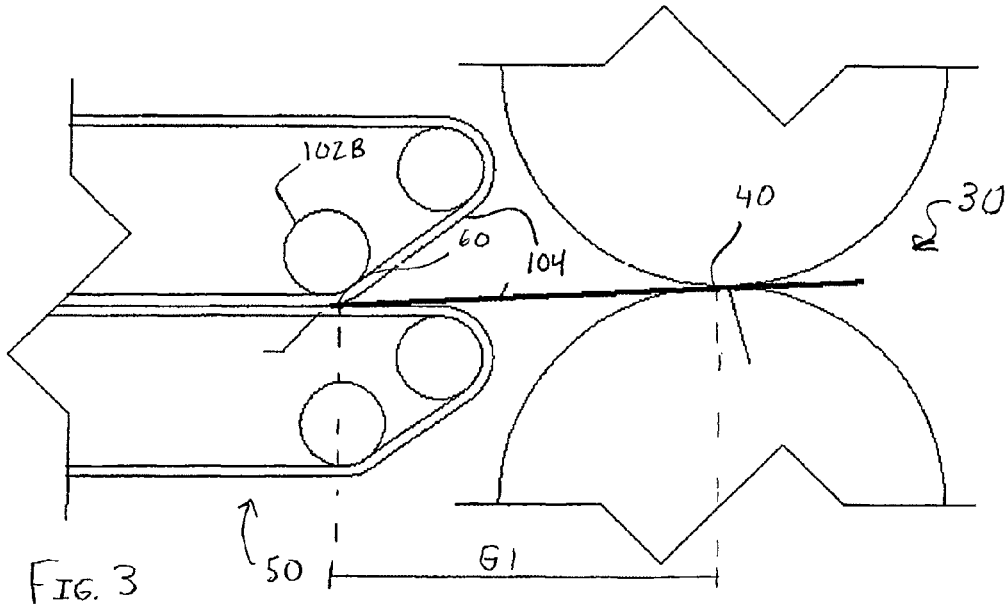
FIG. 3 illustrates an elevation side view of a schematic of a rotary die drum and a takeaway conveyor in accordance with one embodiment of the present disclosure.
Figure 4:
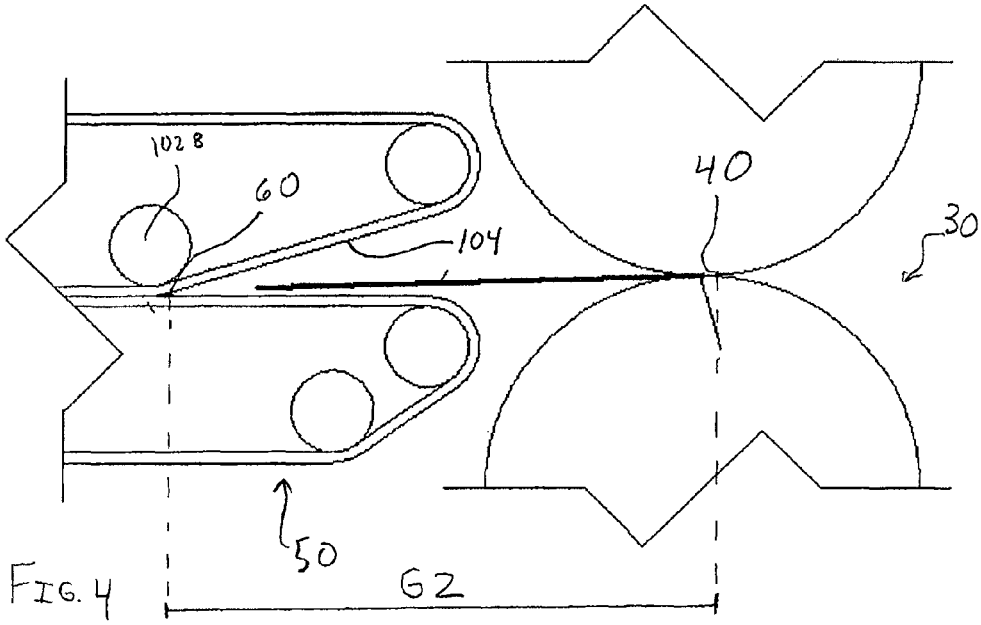
FIG. 4 illustrates an elevation side view of a schematic of a rotary die drum and a takeaway conveyor in accordance with one embodiment of the present disclosure.

In some embodiments, an adjustment drive 70 may be operatively coupled to the takeaway conveyor 50 and configured to move the position of the second nip point 60 in and counter to the conveying direction C, thereby varying the gap distance G. For example, the adjustment drive 70 may be operatively coupled to the nip support roller 102B such that the roller 102B is movable in and counter to the conveying direction C relative to the upper belt 96 and the lower belt 98. As will be appreciated by those skilled in the art, due to the tension in the upper belt 96 provided by the support rollers 102, such movement may, in turn, result in an equivalent movement of the nip point 60 defined between the upper and lower belts 96, 98. In this manner, and as illustrated in FIGS. 3 and 4, the gap distance may be varied between a gap distance G1 and a gap distance G2 to accommodate sheets of varying length. In addition, as can be appreciated from FIGS. 3 and 4, as the gap distance G1, G2 is varied by movement, for example, of the nip support roller 102B, the deflector belt section 104 may, in some embodiments, similarly and automatically be adjusted in size therewith based on the changing distance between support roller 102A and support roller 102B. To accommodate any reduction or increase in tension in the upper belt 96 as a result of movement of the roller 102B in or counter to the conveying direction, one or more other rollers supporting the upper belt 96 may be moved, such as by a biasing member, a drive system, and/or manual manipulation to offset such reduction or increase. In one embodiment, the gap distance G1 and the gap distance G2 may be selected such that the gap distance G may substantially approximate any sheet length the rotary die drum 30 is capable of delivering. Alternatively, the gap distances G1 and G2 may be any desired distances, such as greater or less than the sheet length delivered by rotary die drum 30.

As previously discussed, the adjustment drive 70 may be actuated manually by an operator and/or automatically by a suitable control system. For example, the adjustment drive 70 may include a manual hand wheel, pneumatic actuator, servo motor, or the like. Such devices may be operatively coupled to the nip support roller 102B via, for example, suitable gearing, links, and/or shafts, to effect movement of the nip support roller 102B.

In embodiments in which the adjustment drive 70 is, at least in part, automatically actuatable, the adjustment drive 70 may be operatively coupled to a suitable control system 80. The control system 80 may include any computing device known to those skilled in the art, including standard attachments and components thereof (e.g., processor, memory, sound board, input device, monitor, and the like). The computing device may include software programs or instructions stored in the memory, which are executed by the processor. The computing device may be in operative communication with, for example, the adjustment drive 70 to transmit instructions to effect repositioning of the nip support roller 102B to achieve a desired gap distance G. In one embodiment, the desired gap distance G may be entered into the control system 80 by an operator. Alternatively, or additionally, the control system 80 may be in further communication with one or more sensors 82 positioned and configured to detect the length of the sheets being processed, and to set the gap distance based, at least in part, on the detected length. The sensors 82 may be optical sensors, magnetic sensors, physical sensors, timing sensors, or any other type of sensing device that is configured to automatically detect the length of the sheets being processed.

While the foregoing has been described with respect to embodiments in which the position of the nip point 60 is varied by adjusting the position of the nip support roller 102B, it is to be appreciated that any mechanism for adjusting the position of the nip point 60 is within the scope of the present disclosure. For example, in an alternative embodiment, the position of the nip point 60 may be varied by sliding either or both of the upper and lower belts 96, 98 relative to one another in or counter to the conveying direction C. In such embodiments, it may be desirable to provide additional tooling above the lower belt 98 to approximate the function of the deflector belt section 104, which may be lost if the upper belt 96 is moved downstream relative to the lower belt 98. In a further alternative, one or more sections of either or both of the top and bottom belts 96, 98 that are proximate the rotary die drum 30 may be rotated about an axis that is transverse to the conveying direction to vary the position of the nip point 60 (e.g., a pivoting movement of the upper belt 96 away from the lower belt 98 may increase the gap distance G and a pivoting movement of the upper belt 96 toward the lower belt 98 may decrease the gap distance G. In yet another alternative, the position of the second nip point 60 may remain static and the position of the first nip point 40 may be moved in or counter to the conveying direction C.

Operation of the system and a method aspect of the present disclosure can be understood and described as follows. With reference to FIGS. 1-4, in some embodiments, a first gap distance may be set, which in some embodiments, for example, may approximate the length of a first sheet to be transferred between the rotary die drum 30 and the takeaway conveyor 50. A leading edge of the first sheet (or a web from which the first sheet will be cut by the rotary die drum 30) may be conveyed, via the feed conveyor 20, into the first nip point 40 of the rotary die drum 30. As the first sheet is received within the first nip point 40, the frictional engagement between the upper and lower drums 92, 94 may cause the sheet to be engaged and subsequently processed and conveyed by the rotary die drum 30. After passing through the rotary die drum 30, the leading edge of the sheet may then be fed towards the second nip point 60. Because the first gap distance is set to approximate the first sheet length, as the leading edge is received within the second nip point 60, or just prior to the leading edge being received by the second nip point 60, the trailing edge of the sheet may be released from the first nip point 40. After being received by the second nip point 60, the frictional engagement between the upper and lower belts 96, 98 of the takeaway conveyor 50 may then cause the first sheet to be engaged and conveyed by the takeaway conveyor 50. One or more sheets having the same or substantially the same length as the first sheet may then be similarly transferred from the rotary die drum 30 to the takeaway conveyor 50.

In some embodiments, a second sheet having a length that is different than the length of the first sheet may then be introduced into the rotary die drum 30. As previously discussed, the length of such second sheet may be known by an operator, or automatically detected by one or more sensors. In response to the change in sheet length, at a point prior to a leading edge of the second sheet being captured by the second nip point 60, the adjustment drive 70 may be actuated, manually and/or by the control system 80, to achieve a second gap distance that approximates the length of the second sheet. For example, the adjustment drive 70 may be actuated to move the nip support roller 102B either in or counter to the conveying direction to achieve the second gap distance. In this manner, as with the first sheet having a different length, as the leading edge of the second sheet is received within the second nip point 60, or just prior to the leading edge being received within the second nip point 60, the trailing edge of the second sheet may be released from the first nip point 40, and the second sheet may be subsequently conveyed by the takeaway conveyor 50. Of course, sheets of any number of different lengths may be transferred between the rotary die drum 30 and the takeaway 50 in this manner, with the gap distance being varied in accordance with the sheet length.

Although the various embodiments of the present disclosure have been described with reference to preferred embodiments, persons skilled in the art will recognize that changes may be made in form and detail without departing from the spirit and scope of the present disclosure.

I claim:

1. A system for conveying material, the system comprising:

a processing module configured for transferring the material in a conveying direction, the processing module comprising a first nip point;

a conveyor positioned downstream of the processing module and configured for transferring the material in the conveying direction, the conveyor comprising a first support roller and second support roller having a first conveyor belt wound therearound, the belt defining a deflector section extending from the first support roller to the second support roller, the conveyor further comprising a second nip point, wherein said second support roller is adjustable relative to said first support roller and relative to said processing module, wherein a distance from the processing module to the second nip point is altered without changing a distance from the processing module to the first support roller; and an adjustment drive operatively associated with either or both of the first and second support rollers and configured to adjust the position of the second nip point in or counter to the delivery direction.

2. The system of claim 1, wherein the second nip point is positioned such that a leading edge of the material is fed from the processing module into the second nip point.

3. The system of claim 1, further comprising a control system operatively coupled to the adjustment drive and configured to actuate the adjustment drive.

4. The system of claim 1, wherein the processing module comprises a rotary die drum comprising a top drum and a bottom drum, and wherein the first nip point is defined by a point of convergence of the top and bottom drums.

5. The system of claim 4, wherein the conveyor further comprises a second conveyor belt, wherein the second nip point is defined by an upstream-most point of convergence of the first and second conveyor belts.

6. The system of claim 5, wherein the second support roller is positioned axially below the first support roller and downstream of the first support roller in the conveying direction.

7. The system of claim 1, wherein the adjustment drive is configured to adjust the position of the second support roller in or counter to the conveying direction so as to adjust the position of the second nip point in or counter to the conveying direction, respectively.

8. The system of claim 1, further comprising one or more sensors configured to measure a length of the material, and wherein a control system is provided with programming instructions for actuating the adjustment drive based, at least in part, on the measured material length.

9. The system of claim 1, wherein the material is formed of paperboard or corrugated material.

10. A method for conveying material, the method comprising the steps of:

passing a first sheet of material having a first length through a processing module, the processing module comprising a first nip point;

transporting the first sheet in a conveying direction towards a conveyor positioned down-stream of the processing module and configured for transferring the material in the conveying direction, the conveyor comprising a first support roller and second support roller having a first conveyor belt wound therearound, the belt defining a deflector section extending from the first support roller to the second support roller, the conveyor further comprising a second nip point, wherein a gap distance is defined by the distance between the first nip point and the second nip point, and wherein the gap distance is substantially equal to the first length, adjusting said second support roller relative to said first support roller and relative to said processing module, wherein a distance from the processing module to the second nip point is altered without changing a distance from the processing module to the first support roller;

passing a second sheet of material having a second length through the processing module, wherein the second length is different than the first length; and adjusting the gap distance such that it is substantially equal to the second length.

11. The method of 10, further comprising the step of transporting the second sheet in the conveying direction towards the second nip point.

12. The method of claim 11, wherein the step of adjusting the gap distance is carried out before a leading edge of the second sheet is received by the second nip point.

13. The method of claim 10, wherein the step of passing a first sheet of material having a first length through a processing module includes passing the first sheet of material through a rotary die drum comprising a top drum and a bottom drum, and wherein the first nip point is defined by a point of convergence of the top and bottom drums.

14. The method of claim 13, wherein the step of transporting the first sheet in a conveying direction towards a conveyor includes transporting the first sheet in a conveying direction towards a second conveyor belt, wherein the second nip point is defined by an upstream-most point of convergence of the first and second conveyor belts.

15. The method of claim 14, wherein the step of transporting the first sheet in a conveying direction towards a conveyor includes transporting the first sheet in a conveying direction towards a second support roller positioned axially below a first support roller and downstream of the first support roller in the conveying direction.

16. The method of claim 15, wherein the step of adjusting the gap distance comprises adjusting the position of the second support roller in or counter to the conveying direction so as to adjust the position of the second nip point in or counter to the conveying direction, respectively.

17. The method of claim 10, wherein the steps of passing a first sheet of material having a first length through a processing module includes passing paperboard or corrugated material through the processing module.

18. The method of claim 10, wherein the step of passing a second sheet of material through the processing module includes passing a second sheet of material having a length longer than the gap distance through the processing module.

19. The method of claim 10, wherein the step of passing a second sheet of material through the processing module includes passing a second sheet of material having a length shorter than the gap distance through the processing module.

* * * * *